United States Patent [19]

Wurdack

[11] Patent Number: 4,543,583

[45] Date of Patent: Sep. 24, 1985

[54] DIPOLE ANTENNA FORMED OF COAXIAL CABLE

[75] Inventor: Gerard A. Wurdack, Glencoe, Mo.

[73] Assignee: Gerard A. Wurdack & Associates, Inc., Frontenac, Mo.

[21] Appl. No.: 501,255

[22] Filed: Jun. 6, 1983

[51] Int. Cl.[4] ..... H01Q 9/44; H01Q 1/16; H01Q 3/30

[52] U.S. Cl. ..... 343/792; 343/886; 343/853

[58] Field of Search ..... 343/736, 792, 804, 886, 343/905, 906, 853

[56] References Cited

U.S. PATENT DOCUMENTS 2,668,239 2/1954 Jipp ..... 343/886
4,254,422 3/1981 Kloepfer et al. ..... 343/792

OTHER PUBLICATIONS

Parten; Inverted Vee Yagi, CQ, Dec. 1966, pp. 69, 70.

*Primary Examiner*—Eli Lieberman
*Attorney, Agent, or Firm*—Senniger, Powers, Leavitt and Roedel

[57] ABSTRACT

A dipole antenna and a feedline therefor both formed from coaxial line. The dipole coaxial line has the jacket removed from a central portion thereof to expose the outer conductor which is there severed and spread apart to form a gap exposing the dielectric layer, the lengths of coaxial line on each side of the gap comprising dipole elements. The feedline has the jacket removed from one end portion thereof with its inner conductor being connected to the outer shield conductor of one dipole element on one side of the gap and the outer conductor thereof being connected to the outer shield conductor of the other dipole element on the other side of the gap thereby to form center feedpoint connections between the feedline conductors and the dipole elements. Clamping means comprising a pair of relatively thin flat clamping members of substantially rigid insulating material are provided to be fastened together face to face with the feedpoint connections and adjacent coaxial line portions therebetween. The opposing faces of these clamping members are formed to provide a central cavity for receiving and completely enclosing the center feedpoint connections therein and plurality of passages radiate from said cavity for receiving portions of the dipole coaxial line on opposite sides of the gap and the portion of the feedline adjacent the center feedpoint connections.

14 Claims, 11 Drawing Figures

DIPOLE ANTENNA FORMED OF COAXIAL CABLE

BACKGROUND OF THE INVENTION

This invention relates to dipole antennas and more particularly to coaxial dipole antennas.

The simple dipole antenna using open wire for the dipole elements has long been used by radio amateurs, shortwave listeners, and others. It is easy to construct, inexpensive, and sufficiently compact at the more popular frequencies (e.g., 33 ft. long at 14 MHz) to be erected or strung in a modest-size space. Its radiation pattern is bi-directional broadside to the length of the antenna. It has, however, rather narrow band width, i.e., its efficiency drops off rapidly at frequencies lower and higher than the design frequency. More recently, coaxial dipole antennas have come into rather wide usage. Such antennas have both the dipole elements and the feedline formed from the same type of coaxial cable. The dipole coaxial line, approximately ½ wavelength at the design frequency, has the outer jacket and the outer shield conductor cut and spread apart for a short distance each side of the center to form a gap thereby defining the two dipole elements. The inner and outer conductors of the coaxial feedline are respectively connected, as by soldering, to the outer shield conductors of the dipole elements on each side of the gap, these connections serving as feedpoint connections between the dipole elements of the coaxial feedline. At points spaced outwardly on the dipole elements from the feedpoint connections a small portion of the outer jacket, the outer shield conductor and the dielectric material surrounding the inner conductor are removed and the inner conductor and the outer shield conductors are electrically connected together, as by soldering, to form electrical junctions. Such coaxial dipole antennas have a number of advantages over the simple or open wire dipole antenna. For example, they are efficient over a much greater band width; have a positive gain (1.5 db) over a simple dipole operating under the same relative conditions; attenuate harmonics; decrease static charge build-up; and, when mounted in an inverted V configuration, are essentially nondirectional. However, removal of the jacket and outer shield to form the center gap of the dipole elements and the removal of substantial portions of the jacket, outer shield conductors and inner dielectric at the junctions considerably weaken the antenna at these points and make it susceptible to tensile failure. Also, the feedline connections and the electrical junctions are subject to rain and moisture damage at these points.

SUMMARY OF THE INVENTION

Among the several objects of the present invention may be noted the provision of a coaxial dipole antenna which has substantially the same structural strength as a continuous unbroken length of coaxial line; the provision of such an antenna in which the areas where the jacket and outer shield conductors have been removed are protected against rain and moisture damage; the provision of a dipole antenna which has clamping members which simultaneously provide improved mechanical strength for the dipole elements and protect them against weather damage; and the provision of such a dipole antenna which has clamping means in which mating members of each clamp are identical.

Briefly, a dipole antenna of this invention and its feedline are formed from coaxial line having an inner conductor, an outer shield conductor surrounding the inner conductor, and spaced and insulated therefrom by a flexible dielectric layer therebetween and a jacket of insulating material covering the outer shield conductor. The dipole coaxial line has its jacket removed from a central portion thereof to expose the outer conductor which is there severed and spread apart to form a gap exposing the dielectric layer, the lengths of coaxial line on each side of the gap comprising dipole elements. The feedline has its jacket removed from one end portion thereof with its inner conductor being connected to the outer shield conductor of one dipole element on one side of the gap and the outer conductor thereof being connected to the outer shield conductor of the other dipole element on the other side of the gap thereby to form center feedpoint connections between the feedline conductors and the dipole elements. A portion of the jacket, the outer shield and the dielectric layer are removed from the dipole elements at points spaced from the center feedpoint connections to expose the inner conductor which is electrically connected at these points to the adjacent outer shield conductor thereby to form an electrical junction between the outer shield of each dipole element and the continuous inner conductor. The coaxial line portion extending between these junctions comprises a balun to match the impedance of the dipole elements to the impedance of the feedline. Clamping means comprising a pair of relatively thin flat clamping members of substantially rigid insulating material are provided to be fastened together face to face with the feedpoint connections and adjacent coaxial line portions therebetween. The opposing faces of these clamping members are formed to provide a central cavity for receiving and completely enclosing the center feedpoint connections therein and a plurality of passages radiate from that cavity for receiving portions of the dipole coaxial line on opposite sides of the gap and the portion of the feedline adjacent the center feedpoint connections. These passages have a cross sectional dimension somewhat smaller than that of the coaxial line so that the passage walls grip the coaxial lines passing therethrough and hold them in fixed position with respect to the feedpoint connections in the cavity and with respect to one another for providing strain relief.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
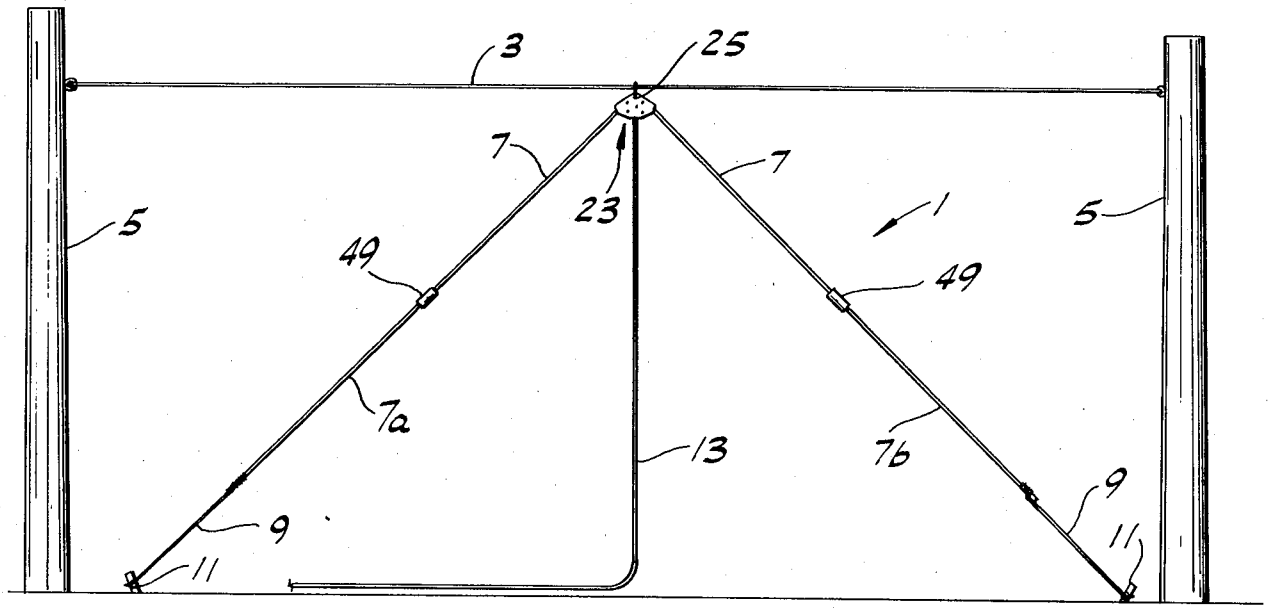
FIG. 1 is a view in elevation of a coaxial dipole antenna of the present invention suspended from an overhead support in a generally inverted V configuration.
Figure 2:
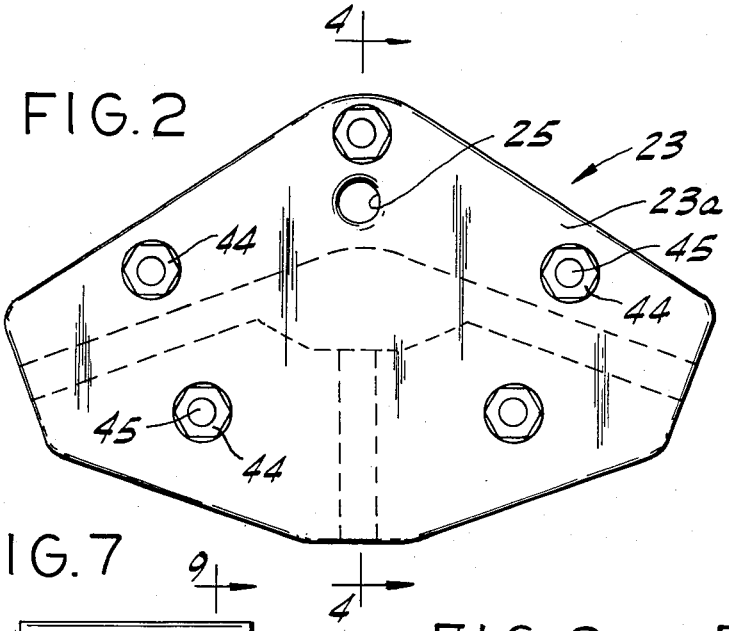
FIG. 2 is a side elevation of a clamp component of the antenna of FIG. 1.
Figure 7:
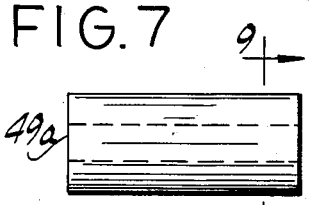
FIG. 7 is a side elevation of another clamp component of the antenna of this invention.
Figure 8:
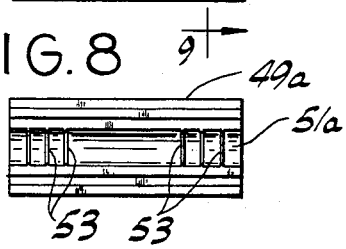
FIG. 8 is an elevation of the inside face of one of the two identical clamp members constituting the clamp of FIG. 7.
Figure 3:
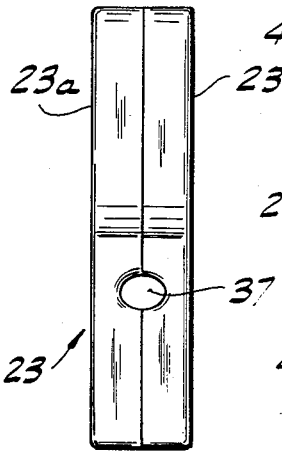
FIG. 3 is an end elevation of the clamp component of FIG. 2.
Figure 4:
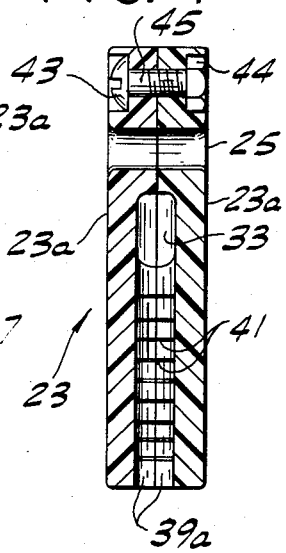
FIG. 4 is a section of the clamp component of FIGS. 2 and 3 taken on line 4—4 of FIG. 2.
Figure 9:
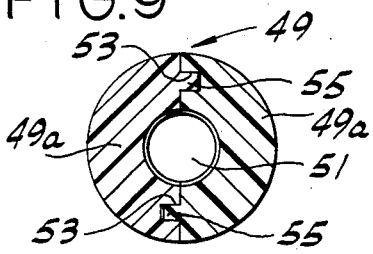
FIG. 9 is an enlarged section taken on line 9—9 of FIG. 7.

Referring now to the drawings and more particularly to FIG. 1, a coaxial dipole antenna of this invention is generally indicated at 1. This antenna is shown suspended from a cable or wire 3 stretched between two masts or posts 5 and comprises a dipole coaxial line 7 formed from a continuous length of coaxial line with two identical dipole elements 7*a* and 7*b*. The opposite ends of line 7 are held spaced apart and secured in position by two lengths 9 of non-conductive line, such as nylon, by tying one end of a line length 9 to a respective end of a dipole element and the other to a respective stake 11. The vertical plane of the antenna may be aligned with masts 5, as illustrated, or positioned at right angles thereto, or at any desired angle simply by moving stakes 11. Antenna 1 may also be mounted in a horizontal or flat top configuration (rather than the inverted V arrangement shown in FIG. 1) wherein the ends of the dipole elements are secured not to stakes but to masts, trees or a house. A feedline 13 interconnects antenna 1 to a transmitter and receiver (not shown) at a remote operating position.

Dipole coaxial line 7 and feedline 13 are made from the same coaxial line (e.g., 52 ohm coaxial line such as that sold under the trade designations RG-8X, RG-8U or RG-58AU) having an inner conductor 15, an outer shield conductor 17 of metallic braid surrounding the inner conductor and spaced and separated therefrom by a flexible dielectric layer 19 therebetween. A jacket 21 of insulating material covers the outer conductor.

Figure 6:
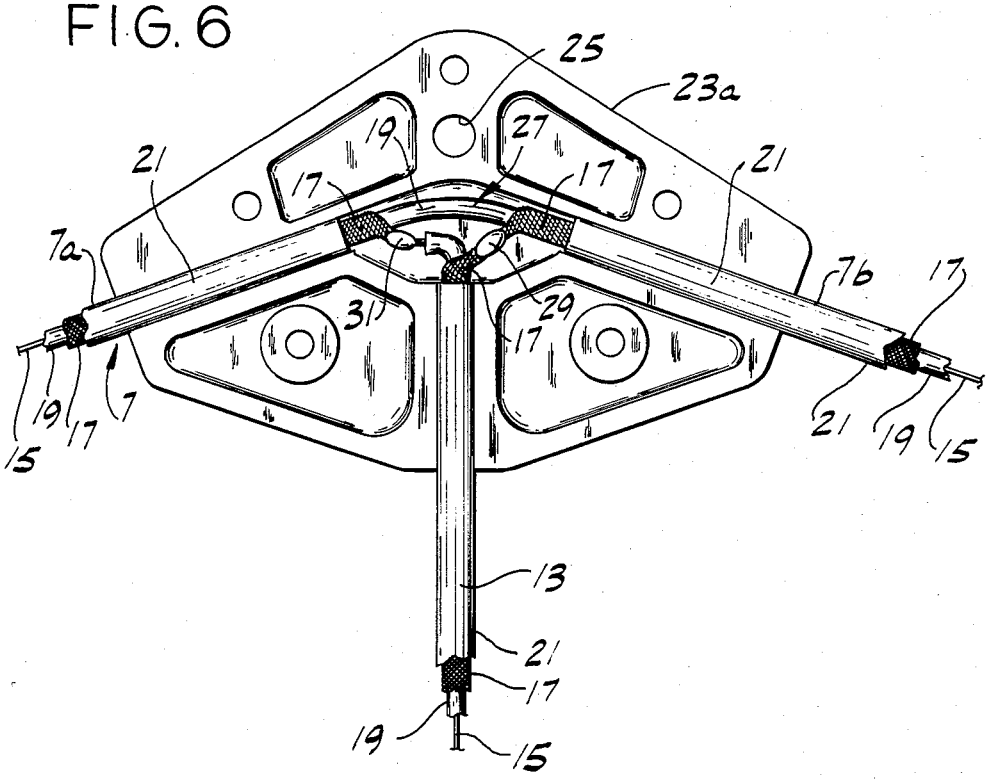
FIG. 6 is an elevation of the clamp member of FIG. 5 with the central portion of the dipole antenna and the top end of the feedline shown in position for clamping.

A clamp component 23 serves to enclose the interconnections between the center of the dipole coaxial line 7 and feedline 13, and also has an aperture 25 for use in suspending antenna 1 if it is to be mounted in the inverted V shape such as shown in FIG. 1. As illustrated in FIG. 6, the dipole coaxial line 7 has a small section of its jacket 21 removed from its center to expose the outer conductor 17 which is cut and spread apart to form a gap 27 exposing the dielectric layer 19. The lengths 7*a* and 7*b* of continuous coaxial line 7 on each side of the gap 27 constitute the dipole elements. The jacket is removed from one end portion of feedline 13 and the exposed outer shield conductor is twisted to form a pigtail which is soldered at 29 to the outer shield 17 of dipole element 7*b* while the bared end of inner conductor 15 of feedline 13 is soldered at 31 to the outer shield 17 of dipole element 7*a*. These two soldered connections 29 and 31 constitute center feedpoint connections between the conductors of feedline 13 and dipole elements 7*a* and 7*b*. Preferably the soldered connections 29 and 31 are taped and then coated with a silicone sealer.

The clamping means, i.e., clamp component 23 comprises two identical thin flat clamping members 23*a* molded of relatively rigid insulating material, such as a polyamide synthetic resin with fiber glass filler, e.g., that sold by E. I. DuPont de Nemours & Co. under the trade designation "Zytel" 77G33L. Each clamping member 23*a* has a central recess 33*a* and grooves 37*a* and 39*a* which radiate therefrom. When fastened together face to face the opposed recesses 33*a* of members 23*a* form a central cavity 33 to receive and enclose the feedpoint connections and grooves 37*a* and 39*a* cooperate to form passages 37 and 39 to grip the adjacent coaxial line portions of dipole elements 7*a* and 7*b* and feedline 13. These passages have a cross-sectional dimension which is somewhat smaller than that of the coaxial line. Thus when clamp members 23*a* are fastened together face to face to enclose the feedpoint connections in the cavity, the coaxial lines are held in a fixed position and gripped to provide strain relief. Passages 37 diverge at an obtuse angle as they radiate from cavity 33 and have parallel spaced circumferential ribs 41 as does passage 39 which bisects that angle. That angle is approximately 135° which is a compromise between the desired angle (approximately 90°) between the dipole elements when stretched out in an inverted V configuration and the desired angle (180°) when supported at their ends in a substantially flat and horizontal configuration. The clamp members 23*a* each have five identical external recesses 43 that are sized to be slightly smaller than hex head nuts 44 into which are threaded bolts 45 for firmly fastening clamp members 23*a* together face to face. This permits the use of identical parts and simplifies assembly as the nuts 44 will be pulled into the recesses and held against rotation while tightening the bolt with a screwdriver. Also, it is preferred that the exterior ends of passages 37 and 39 be relieved to accommodate the movement of the feedline and coaxial dipole elements caused by winds.

Figure 10:
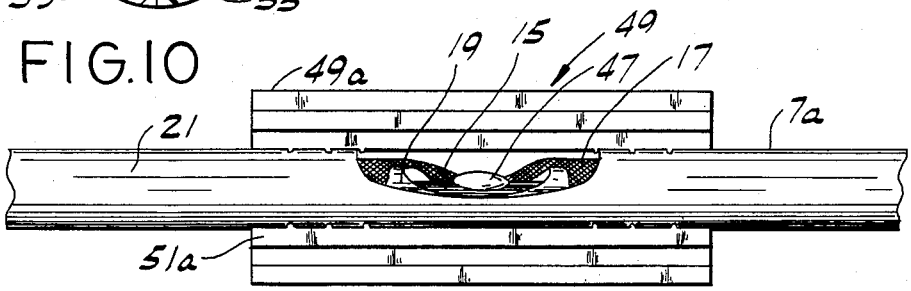
FIG. 10 is an elevation on an enlarged scale of the inside face of one of the two clamp members constituting the clamp component of FIGS. 7 and 8 with a portion of one of the coaxial dipole elements in which an electrical junction is formed shown in position for enclosing the junction and clamping the coaxial line on each side of the junction.
Figure 5:
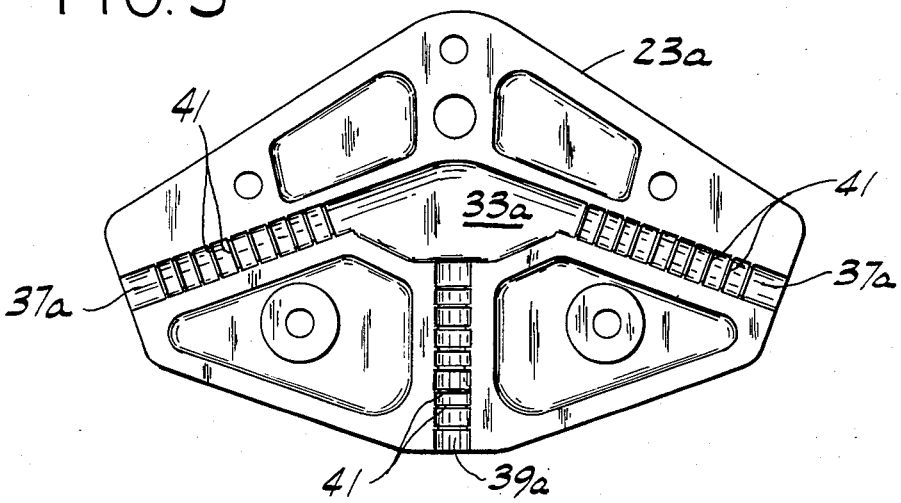
FIG. 5 is an elevation of the inside face of one of the two identical clamp members constituting the clamp of FIGS. 2–4.

Each of the dipole elements 7*a* and 7*b* has a portion of the jacket, the outer conductor and the dielectric layer removed at a point spaced from the center feedpoint connections (FIG. 10). This point is generally located about 50–60% of the length of the dipole element away from center gap 27. The inner conductor 15 which is thereby exposed is soldered at 47 to the outer shield to form an electrical junction. These two junctions are, in effect, tuned shorts whereby the coaxial line portion extending between the junction 47 or short in dipole element 7*a* and that in dipole element 7*b* comprises a balun to match the impedance of the dipole elements to the impedance of feedline 13.

The exposed electrical junctions 47 of each dipole element are protected by elongate clamp components 49 (FIGS. 7–10) of substantially rigid insulating material and molded from the same synthetic resin material, for example, from which the clamping members 23*a* are fabricated. Each clamp component 49 comprises two identical channel-shaped clamp members 49*a* each having a central longitudinal groove 51*a* which, when fastened together face to face, cooperate to form a passage 51 with parallel spaced circumferential ribs 53. Passage 51 is sized to have a cross-sectional dimension slightly smaller than that of the dipole elements 7*a* and 7*b* so that the coaxial cable portions on each side of junctions 47 are firmly gripped to provide strain relief. The face of each clamp member 49*a* has a longitudinal groove 53 on one side margin thereof and a longitudinal rib or tongue 55 along the other side margin thereof. The rib and groove, which constitute tongue and groove means, are complementary in size and shape so that there is a press-fit between them when members 49 are positioned face to face and forced together. Preferably the opposing faces of clamp members 49*a* have a coating of a bonding material such as a cyanoacrylic type glue applied just prior to pressing them together. Also, it is preferred that the ends of dipoles 7*a* and 7*b* be sealed by tape or a waterproof sealant.

When so assembled and installed dipole antennas of this invention are essentially weatherproof and have substantially the strength of the original coaxial line. It is preferred that the antenna be mounted between $\frac{1}{4}$ and $\frac{1}{2}$ wavelength above ground. It will operate well at lesser distances but the band width tends to decrease at such lesser distances.

Figure 11:
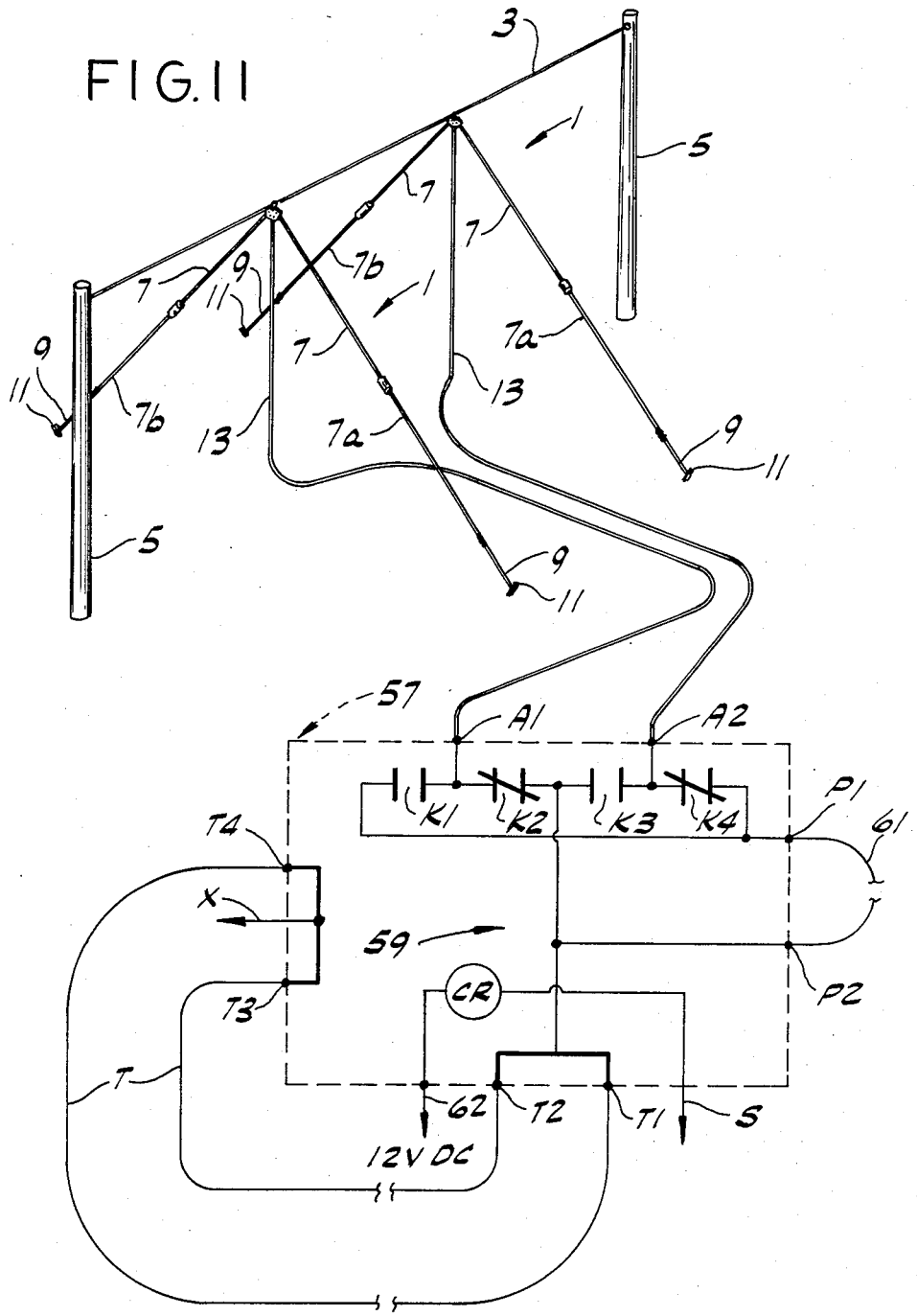
FIG. 11 is a perspective view of an antenna system of this invention comprising two identical coaxial dipole antennas and a control box therefor shown schematically and on an enlarged scale.

Referring now to FIG. 11, an antenna system of this invention is illustrated and comprises a pair of antennas 1 suspended from cable or wire 3. The dipole elements 7*a* and 7*b* are cut to be equal in length and the two feedlines 13 are also cut to be identical in length. These antennas are positioned in parallel planes. They are connected via conventional coaxial connectors at terminals A1 and A2 of a controller 57, comprising a metal box enclosing a double-pole double-throw relay 59 with a coil CR and contacts K1–K4. Contacts K1 and K3 are normally open while K2 and K4 are normally closed contacts. Controller 57 also includes a pair of terminals P1 and P2 which are connected to the opposite ends of a coaxial phasing line 61. Two additional lengths of coaxial line T constituting a matching transformer are connected between coaxial terminal connectors T1,T3 and T2,T4. T1 and T2 are commonly connected inside controller 57 to the electrical junction between sets of contacts K2,K3 and terminal P2 of phasing line 61. The other end of phasing line 61 is commonly connected to sets of contacts K1,K4. The remaining ends of the matching transformer lines T at terminals T3,T4 are commonly connected to a coaxial line X which is connected selectively to the receiver and transmitter coupled to this antenna system. One terminal of relay coil CR is connected to a source of electrical power, preferably 12 V. DC supplied via a line 62 by a power pack (not shown), while the other terminal of CR is connected via controller terminal S to a switch and the 12 V. power pack and a control box remotely located at the transmitter/receiver operating position.

Certain phase and matching relationships are to be observed in connecting this antenna system. Thus, the feedlines 13 are to be cut equal in length and be an odd multiple of a $\frac{1}{4}$ wavelength at the resonant frequency of the dipole antenna being fed. The phasing and matching transformer coaxial lines 61 and T are cut from the same coaxial line that is used for the dipole and feedline components. These lines are each cut to an electrical $\frac{1}{4}$ wavelength at the resonant frequency to which the dipole elements are cut. By electrical $\frac{1}{4}$ wavelength is meant the physical length of the coaxial line corresponding to $\frac{1}{4}$ wavelength at the resonant frequency multiplied by the velocity factor of the particular coaxial cable being used. This factor, which typically is in the order of 0.66 to about 0.8 compensates for the difference in velocity of the radio frequency energy being conducted by the coaxial line and the velocity of that energy when propagated in space.

The parallel-connected matching transformer coaxial lines T provide a match between the parallel-connected antennas 1 (viz., an impedance about 26 ohms using 52 ohm coaxial cable) and the transmitter/receiver coaxial line X. The phasing line 61 ensures that the rf energy supplied to the two parallel-connected antennas is properly phased to obtain the desired directivity pattern. That is, with the antennas being parallel and spaced about $\frac{1}{8}$ to $\frac{1}{4}$ wavelength (again at the frequency to which these antennas have been cut to resonate), the rf energy is fed into the respective antennas 90° ($\frac{1}{4}$ wavelength) out of phase by connecting the phasing line in series with one antenna and directly connecting the rf to the other antenna. This will result in a gain of about 5 db. in a given broadside direction and a 10–25 db. front-to-back ratio. In order to reverse the directivity pattern the phasing line is simply series connected with the rf feedline supplying the second antenna while the first one is supplied directly with the rf from the transmitter. This change in directivity is conveniently accomplished by manually actuating the switch at the remote operating position with the contacts K1–K4 serving as a reversing switch and transferring the phasing line from a series relationship with the first antenna's feedline to a series relationship with the second antenna's feedline.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A dipole antenna and a feedline therefor both formed from coaxial line having an inner conductor, an outer shield conductor surrounding said inner conductor and spaced and insulated therefrom by a flexible dielectric layer therebetween and a jacket of insulating material covering the outer shield conductor; said dipole coaxial line having said jacket removed from a central portion thereof to expose the outer conductor which is there severed and spread apart to form a gap exposing the dielectric layer, the lengths of coaxial line on each side of the gap comprising dipole elements; the feedline having the jacket removed from one end portion thereof with the inner conductor thereof being connected to the outer shield conductor of one dipole element on one side of the gap and the outer conductor thereof being connected to the outer shield conductor of the other dipole element on the other side of the gap thereby to form center feedpoint connections between the feedline conductors and the dipole elements; a portion of the jacket and the outer shield and the dielectric layer being removed from the dipole elements at points spaced from the center feedpoint connections to expose the inner conductor which is electrically connected at these points to the adjacent outer shield conductor thereby to form an electrical junction between the outer shield of each dipole element and the continuous inner conductor, the coaxial line portion extending between these junctions comprising a balun to match the impedance of the dipole elements to the impedance of the feedline; and clamping means comprising a pair of relatively thin flat clamping members of substantially rigid insulating material adapted to be fastened together face to face with said feedpoint connections and adjacent coaxial line portions therebetween, the opposing faces of said members being formed to provide a central cavity for receiving and completely enclosing said center feedpoint connections therein and a plurality of passages radiating from said cavity for receiving portions of the dipole coaxial line on opposite sides of the gap and the portion of the feedline adjacent said center feedpoint connections, said passages having a cross sectional dimension somewhat smaller than that of the coaxial line whereby the passage walls are adapted to grip the coaxial lines passing therethrough and to hold them in fixed position with respect to said feedpoint connections in said cavity and with respect to one another for providing strain relief.

2. An antenna as set forth in claim 1 wherein the opposing faces of said clamping members have a plurality of grooves therein which, when said clamping members are fastened together face to face, cooperate to form said passages.

3. An antenna as set forth in claim 2 wherein the clamping members are identical in size and shape.

4. An antenna as set forth in claim 3 wherein the passages receiving and gripping said dipole coaxial line portions on opposite sides of said gap diverge at an obtuse angle as they radiate from the cavity and the passage for receiving and gripping said feedline portion bisects that angle.

5. An antenna as set forth in claim 4 wherein each of the aforesaid passages has a plurality of spaced circumferential ribs to positively grip the jacket of said coaxial line portions.

6. An antenna as set forth in claim 5 in which said clamping means has an aperture therein for use in suspending the antenna above the ground with the free ends of dipole elements held spaced apart and secured to form a generally inverted V-shaped coaxial dipole antenna.

7. An antenna as set forth in claim 1 which further includes second clamping means comprising a pair of elongate clamping members of substantially rigid insulating material adapted to be fastened together face to face to provide a passage for receiving one of said junctions and the dipole coaxial line portions immediately adjacent thereto, said elongate clamping member passage having a cross sectional dimension somewhat smaller than that of the coaxial line whereby the passage walls are adapted to grip the dipole coaxial line portions on opposite sides of the junction for enclosing the junction and providing strain relief.

8. An antenna as set forth in claim 7 wherein said elongate clamping members are channel-shaped to provide longitudinal grooves which, when the elongate clamping members are fastened together face to face, cooperate for form said passage.

9. An antenna as set forth in claim 8 wherein the opposing faces of said elongate clamping members have cooperating tongue and groove means which, when forced together, mate to connect the clamping members and to hold them in gripping engagement with said dipole coaxial line portions on opposite sides of the junction.

10. An antenna as set forth in claim 9 wherein said elongate clamping members are identical, each having a longitudinal tongue along one side margin of one face thereof and a longitudinal groove along the other side margin of said one face thereof.

11. An antenna as set forth in claim 10 wherein the passage of the second clamping means has a plurality of spaced circumferential ribs for positively gripping the jacket of the coaxial line on each side of said junction.

12. An antenna system comprising a pair of antennas each as set forth in claim 1 wherein all the dipole elements are equal in length and both of the feedlines are equal in length, said antennas adapted to be suspended above the ground the same height, parallel one with the other, and spaced apart $\frac{1}{8}$ wavelength or a multiple thereof at the resonant frequency of the dipole antennas; a coaxial phasing line, one end of which is adapted to be selectively connected to either feedline; a matching transformer comprising two equal lengths of coaxial line electrically connected in parallel, the lengths of the coaxial phasing line and the coaxial lines of the matching transformer being equal to an electrical $\frac{1}{4}$ wavelength at the common resonant frequency of the dipole antennas, the other end of the phasing line being connected to one end of the matching transformer, the other end of the matching transformer adapted to be selectively connected to a transmitter and a receiver; and means for alternatively connecting the one end of the phasing line to a selected one of the feedlines while concurrently connecting the other of the feedlines to the one end of the matching transformer whereby the directivity pattern of the antennas may be reversed.

13. An antenna system as set forth in claim 12 wherein said means for alternatively connecting the phasing line to different feedlines to change the directivity pattern includes a relay adapted to be controlled from a remote location.

14. An antenna system as set forth in claim 13 wherein said relay is double-pole double-throw relay and is adapted to be controlled from a remote location by a switch.

* * * * *